US008122868B2

(12) United States Patent
Zavala Jurado et al.

(10) Patent No.: US 8,122,868 B2
(45) **Date of Patent: *Feb. 28, 2012**

(54) METHOD AND SYSTEM FOR ESTIMATING AND REDUCING ENGINE AUTO-IGNITION AND KNOCK

(75) Inventors: Jose C Zavala Jurado, Ann Arbor, MI (US); Charles H. Folkerts, Troy, MI (US); Karl T. Kiebel, Royal Oak, MI (US)

(73) Assignee: GM Global Technology Operations LLC

( * ) Notice: Subject to any disclaimer, the term of this patent is extended or adjusted under 35 U.S.C. 154(b) by 257 days.

This patent is subject to a terminal disclaimer.

(21) Appl. No.: 12/567,093

(22) Filed: Sep. 25, 2009

(65) Prior Publication Data

US 2011/0077846 A1 Mar. 31, 2011

(51) Int. Cl.
*F02P 5/00* (2006.01)

(52) U.S. Cl. ..... 123/406.11; 123/406.26; 123/406.28; 123/406.22

(58) Field of Classification Search ..... 123/406.11, 123/406.12, 406.17, 406.18, 406.22, 406.26–406.29
See application file for complete search history.

(56) References Cited

U.S. PATENT DOCUMENTS 7,290,442 B2 * 11/2007 Zhu et al. ..... 73/114.67
7,318,411 B1 * 1/2008 Zhu et al. ..... 123/406.26
2006/0042355 A1 * 3/2006 Zhu et al. ..... 73/35.08

OTHER PUBLICATIONS

U.S. Appl. No. 12/412,729, filed Mar. 27, 2009, Charles H. Folkerts.

* cited by examiner

*Primary Examiner* — John Kwon

(57) ABSTRACT

A control system for an engine includes a heat-release rate (HRR) module, a first filter module, a second filter module, an auto-ignition energy determination module, and a corrective action module. The HRR module generates an HRR signal based on in-cylinder pressures of a cylinder of the engine. The first filter module generates a first filtered HRR signal indicative of a first HRR due to combustion in the cylinder by filtering the HRR signal. The second filter module generates a second filtered HRR signal indicative of a second HRR due to auto-ignition in the cylinder by filtering one of the HRR signal and the first filtered HRR signal. The auto-ignition energy determination module determines an auto-ignition energy of the cylinder based on the first and second filtered HRR signals. The corrective action module selectively adjusts auto-ignition of the engine based on the auto-ignition energy. A related method is also provided.

20 Claims, 6 Drawing Sheets

METHOD AND SYSTEM FOR ESTIMATING AND REDUCING ENGINE AUTO-IGNITION AND KNOCK

FIELD

The present disclosure relates to methods and systems for estimating auto-ignition energy in a combustion chamber for an engine, and more particularly, to methods and systems for reducing auto-ignition and knock in an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust a mixture of air and fuel in cylinders and thereby produce drive torque. Combustion occurs within combustion chambers defined by the cylinders. Combustion may be initiated by a spark that supplies energy to the air-fuel mixture and thereby initiates combustion. Once initiated, combustion in the combustion chamber continues along a flame front for a period. Timing of the combustion may be generally controlled by controlling the timing of the spark. The timing of the spark may be controlled relative to a position of pistons that reciprocate within the cylinders and/or a rotational position of a crankshaft coupled to the pistons. For example, the timing of the spark may be controlled relative to a top-dead-center (TDC) position of the pistons. At TDC, the volume of the combustion chamber is at its smallest volume.

Spontaneous combustion of a portion of the air-fuel mixture within the combustion chamber may occur when a pressure wave created by the spark-initiated combustion travels faster than the flame front of the spark-initiated combustion. The pressure wave may result in a rapid pressure rise in end gases within the cylinders that causes the end gases to self-ignite (i.e., auto-ignite). Auto-ignition of the end gases may result in rapid combustion or detonation of the entire volume of end gases. Auto-ignition of the end gases results in a rapid release of heat that causes a rapid rise in cylinder pressure that may cause the cylinder pressure to resonate at natural acoustic frequencies of the combustion chamber. Sustained oscillations of the pressure waves may cause metal surfaces of the combustion chamber to vibrate and produce an audible sound referred to as engine knock. Thus, engine knock may occur as an impulse response of the combustion chamber in response to the rapid pressure rise caused by auto-ignition of the end gases and the resulting heat release.

Engines may be provided with a knock control system that detects the presence and intensity of engine knock. Several approaches have been developed to detect the presence of engine knock. In one approach, an accelerometer senses the mechanical vibration induced in the engine block structure as a result of the oscillating pressure wave in the combustion chamber. The energy of the mechanical vibration is used as an index of the intensity of the engine knock. The knock intensity may be determined by one of several methods, such as the integral of the square of the oscillation waveform or the maximum peak-to-peak value of the oscillations. In another approach, a pressure sensor senses cylinder pressure and thereby detects the oscillations in the cylinder pressure. Similar to the block structure vibration method, the energy of the pressure oscillations is used as an index of the knock intensity.

Based on the knock intensity, corrective action may be taken to inhibit engine knock. For example, engine spark timing may be retarded to slow down the rate of combustion to a rate that prevents the occurrence of engine knock. As such, knock control systems may be provided during engine development to assist in developing engine spark calibrations that reduce the occurrence of engine knock. In production engines, knock control systems may be provided to adjust spark timing in real time to a point where the engine knock disappears.

SUMMARY

The present disclosure provides a method and a system for estimating the auto-ignition energy and determining an auto-ignition energy metric that may be used to take corrective action that inhibits the occurrence of engine knock.

In one form, the present disclosure provides a control system for an engine that includes a heat-release rate (HRR) module, a first filter module, a second filter module, an auto-ignition energy determination module, and a corrective action module. The HRR module generates an HRR signal based on in-cylinder pressures of a cylinder of the engine. The first filter module generates a first filtered HRR signal indicative of a first HRR due to combustion in the cylinder by filtering the HRR signal. The second filter module generates a second filtered HRR signal indicative of a second HRR due to auto-ignition in the cylinder by filtering one of the HRR signal and the first filtered HRR signal. The auto-ignition energy determination module determines an auto-ignition energy of the cylinder based on the first and second filtered HRR signals. The corrective action module selectively adjusts auto-ignition of the engine based on the auto-ignition energy.

In one feature, the first filter module may generate a low-pass filtered HRR signal by applying a low-pass filter to the HRR signal and may generate a band-pass filtered HRR signal by one of applying a band-pass filter to the HRR signal and applying a high-pass filter to the low-pass filtered HRR signal. In a related feature, the auto-ignition energy is determined based on the low-pass and band-pass filtered HRR signals.

In another feature, the control system may further include a window determination module that determines a search window for an auto-ignition event based on the low-pass filtered HRR signal and that determines an auto-ignition event window for the auto-ignition event based on the band-pass filtered HRR signal and the search window. In a related feature, the auto-ignition determination module determines the auto-ignition energy based on an area defined by a segment of the band-pass filtered HRR signal corresponding to the auto-ignition event window. In another related feature, the window determination module may set the search window to begin at one of a first crankshaft position at a maximum peak in the low-pass filtered HRR signal and a second crankshaft position at an inflection point in the low-pass filtered HRR signal, The search window may have a predetermined duration that is a function of one of a speed, load, and temperature of the engine. The predetermined duration may be further based on a predetermined percent of a total heat released during a combustion event.

In another related feature, the window determination module may locate a maximum peak in the band-pass filtered HRR signal within the search window, determine a first crankshaft position where the band-pass filtered HRR signal increases above a first level prior to the peak, determine a second crankshaft position where the band-pass filtered HRR signal decreases below a second level after the peak, and set the auto-ignition event window to begin at the first crankshaft position and to end at the second crankshaft position. In a related feature, the first and second crankshaft positions may correspond to positive peaks in a second derivative of the band-pass filtered HRR signal nearest to the maximum peak where first derivatives of the band-pass filtered HRR signal are approximately equal to zero. In another related feature, the auto-ignition energy determination module may determine the auto-ignition energy of the cylinder by integrating the band-pass filtered HRR signal over the auto-ignition event window.

In further features, auto-ignition determination module may determine a moving average auto-ignition energy for a plurality of combustion cycles of the cylinder. In a related feature, the corrective action module may selectively adjust the auto-ignition based on a comparison of the moving average auto-ignition energy and a threshold energy.

In still further features, the control system may further include a metric determination module that determines an auto-ignition energy metric for the engine based on one of a maximum of the auto-ignition energy for a plurality of cylinders of the engine and a maximum moving average auto-ignition energy for a plurality of cylinders of the engine. In a related feature, the corrective action module may selectively adjust the auto-ignition based on a comparison of a threshold energy and the one of the maximum of the auto-ignition energy and the maximum moving average auto-ignition energy.

In another form, the present disclosure provides a method for controlling an engine that includes generating an HRR signal based on in-cylinder pressures of a cylinder of the engine, generating a first filtered HRR signal indicative of a first HRR due to combustion in the cylinder by filtering the HRR signal, generating a second filtered HRR signal indicative of a second HRR due to auto-ignition in the cylinder by filtering one of the HRR signal and the first filtered HRR signal, determining an auto-ignition energy of the cylinder based on the first and second filtered HRR signals, and selectively adjusting auto-ignition of the engine based on the auto-ignition energy.

In one feature, the generating a first filtered HRR signal may include applying a low-pass filter to the HRR signal and the generating a second filtered HRR signal may include one of applying a band-pass filter to the HRR signal and applying a high-pass filter to the low-pass filtered HRR signal. In a related feature, the auto-ignition energy is determined based on the low-pass and band-pass filtered HRR signals.

In another feature, the method may further include determining a search window for an auto-ignition event based on the low-pass filtered HRR signal, and determining an auto-ignition event window for the auto-ignition event based on the band-pass filtered HRR signal and the search window. In a related feature, the determining an auto-ignition energy includes determining an area defined by a segment of the band-pass filtered HRR signal corresponding to the auto-ignition event window. In another related feature, the determining a search window may include setting the search window to begin at one of a first crankshaft position at a maximum peak in the low-pass filtered HRR signal and a second crankshaft position at an inflection point in the low-pass filtered HRR signal. The search window may have a predetermined duration that is a function of one of a speed, load, and temperature of the engine. The predetermined duration may be further based on a predetermined percent of a total heat released during a combustion event.

In another related feature, the determining an auto-ignition event window may include locating a maximum peak in the band-pass filtered HRR signal within the search window, determining a first crankshaft position where the band-pass filtered HRR signal increases above a first level prior to the peak, determining a second crankshaft position where the band-pass filtered HRR signal decreases below a second level after the peak, and setting the auto-ignition event window to begin at the first crankshaft position and to end at the second crankshaft position. In a related feature, the first and second crankshaft positions may correspond to positive peaks in a second derivative of the band-pass filtered HRR signal nearest to the maximum peak where first derivatives of the band-pass filtered HRR signal are approximately equal to zero. In another related feature, the determining an area may include integrating the band-pass filtered HRR signal over the auto-ignition event window.

In further features, the determining an auto-ignition energy may include determining a moving average auto-ignition energy for a plurality of combustion cycles of the cylinder. In a related feature, the selectively adjusting auto-ignition may include comparing the moving average auto-ignition energy and a threshold energy.

In still further features, the method may further include determining an auto-ignition energy metric for the engine based on one of a maximum of the auto-ignition energy for a plurality of cylinders of the engine and a maximum moving average auto-ignition energy for a plurality of cylinders of the engine. In a related feature, the selectively adjusting auto-ignition may include comparing of a threshold energy and the one of the maximum of the auto-ignition energy and the maximum moving average auto-ignition energy.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
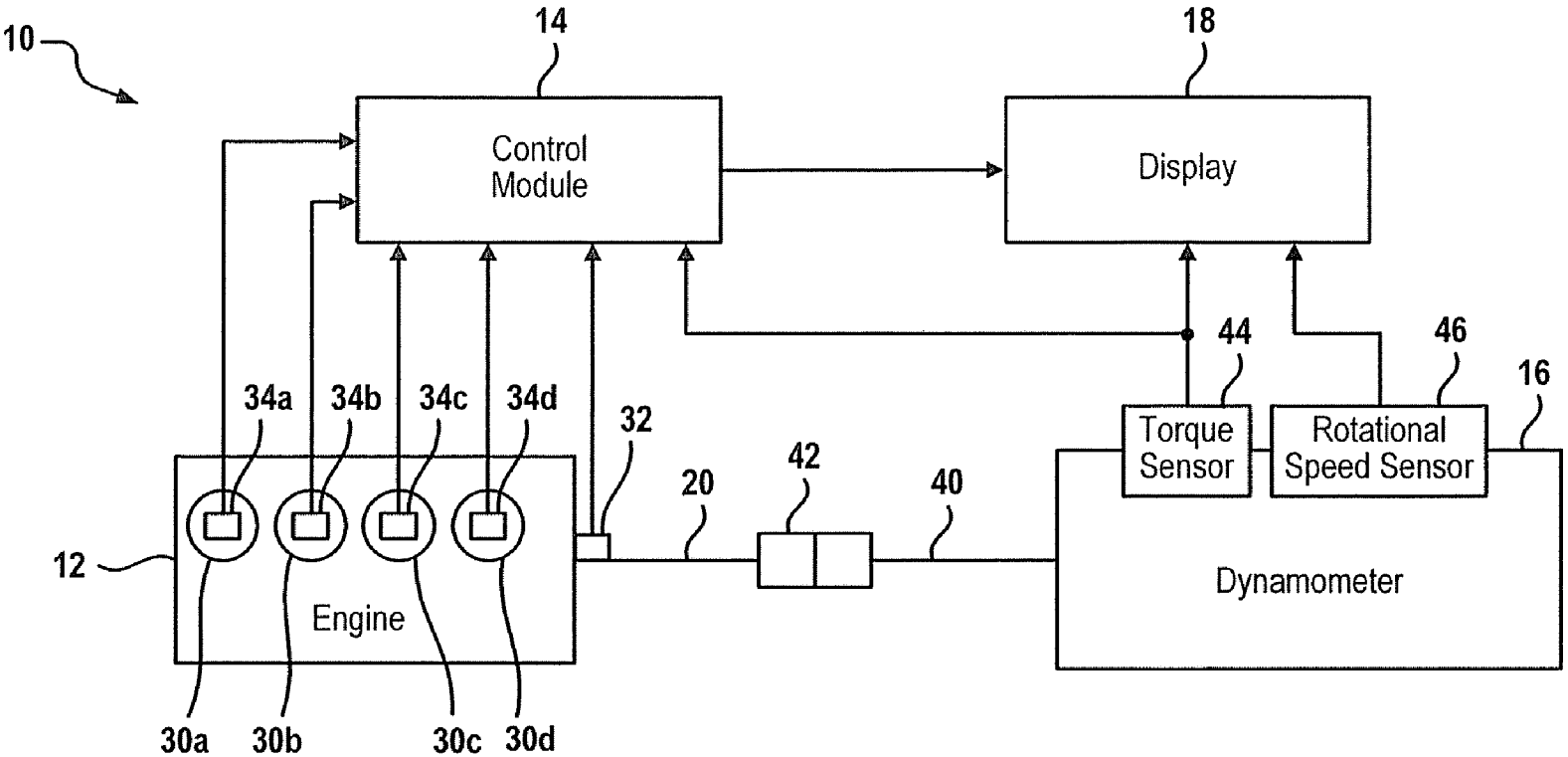
FIG. 1 is a functional block diagram of an exemplary control system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

With particular reference to FIG. 1, an exemplary engine and knock control system 10 according to the present disclosure is shown. The engine and knock control system 10 includes an engine 12 in communication with a control module 14. The engine 12 may be coupled to a dynamometer 16 as shown or, alternatively, may be coupled to a drivetrain of a vehicle (not shown). The control module 14 may be in communication with a display 18.

The engine 12 is an internal combustion engine that combusts a mixture of air and fuel in cylinders to produce drive torque. As discussed herein, the engine 12 is of the spark-ignition type. The engine 12 is not limited to combusting fuel of a particular type. As such, it should be understood that the principles of the present disclosure may be applied to engines, such as but not limited to, gasoline and diesel engines. The engine 12 is not limited to a particular configuration. The engine 12 may be a reciprocating in-line piston engine as shown. Alternatively, the engine 12 may be of the reciprocating V-type, or of the rotary type.

The engine 12 may include one or more cylinders. For exemplary purposes, the engine 12 includes four cylinders 30*a*, 30*b*, 30*c*, and 30*d*. Combustion of the air-fuel mixture drives pistons (not shown) located within the cylinders 30*a-d* that are coupled to a crankshaft 20. Reciprocating motion of the pistons causes the crankshaft 20 to rotate and thereby transmit the drive torque. The engine 12 may include a crankshaft sensor 32 that senses rotation of the crankshaft 20. The crankshaft sensor 32 may generate a crankshaft signal based on the rotation sensed that is output to the control module 14. Based on the crankshaft signal generated, the control module 14 may determine crankshaft position and speed. In this manner, the control module 14 may also determine engine speed.

The engine 12 may further include pressure sensors 34*a*, 34*b*, 34*c*, and 34*d* located in cylinders 30*a-d*, respectively. Each of the in-cylinder pressure sensors 34*a-d* senses a pressure within the corresponding cylinder and generates an in-cylinder pressure signal based on the pressure sensed that is communicated to the control module 14.

The control module 14 may be an engine control module, or a dynamometer control module, or both. As an engine control module, the control module 14 may regulate operation of the engine 12. As a dynamometer control module, the control module 14 may regulate operation of the dynamometer 16. The control module 14 may regulate operation based on signals received from the engine 12 and/or the dynamometer 16. The control module 14 may communicate information on the operation of the engine 12 and/or the dynamometer 16 to the display 18. As discussed in further detail below, the control module 14 estimates an auto-ignition energy of the engine 12 and determines an auto-ignition energy metric. Based on the auto-ignition energy metric, the control module 14 selectively corrects the auto-ignition.

The dynamometer 16 may measure engine speed and the drive torque produced by the engine 12. The dynamometer 16 may include a drive shaft 40 that is coupled to the crankshaft 20 by a coupler 42. The dynamometer may further include a torque sensor 44 and a rotational speed sensor 46. The torque sensor 44 may sense a torque transmitted to the drive shaft 40 by the crankshaft 20 via the coupler 42. The torque sensor 44 may generate a torque signal based on the torque sensed that may be output to the control module 14 and the display 18 as shown. The rotational speed sensor 46 may sense a rotational speed of the dynamometer 16 and may generate a dynamometer speed signal based on the rotational speed sensed that is output to the display 18. The dynamometer speed signal may also be output to the control module 14 (not shown).

The display 18 may be in communication with the control module 14 and the dynamometer 16 and may convey (e.g., display) various information to a dynamometer operator or to a vehicle operator. The information may include one or more operating conditions of the engine 12 and/or dynamometer 16. As discussed herein, the information may include the estimated auto-ignition energy and auto-ignition energy metric. The information may further include information that indicates corrective action should be undertaken to adjust the auto-ignition energy and thereby inhibit engine knock.

Figure 2:
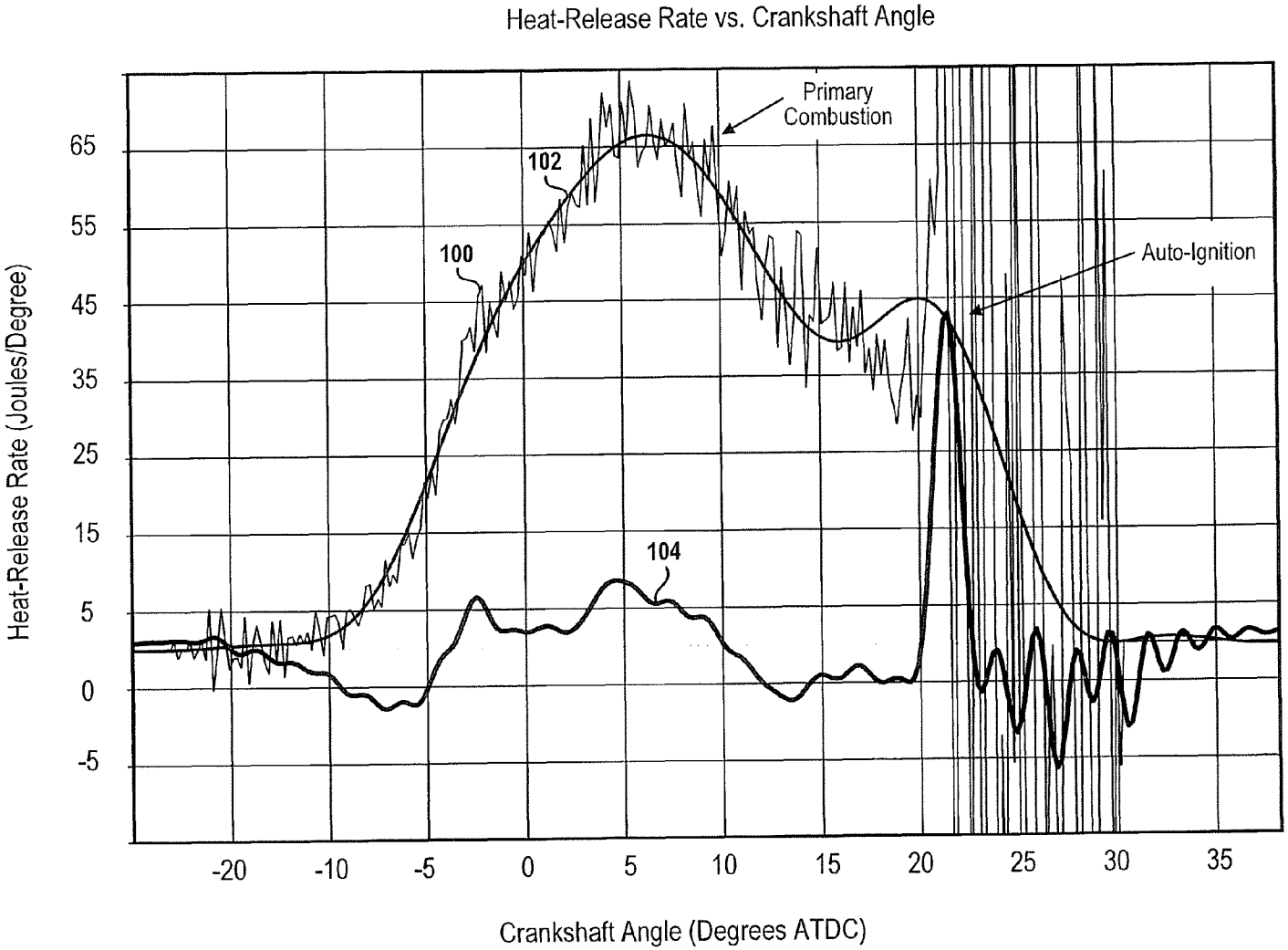
FIG. 2 is a plot of heat-release rate versus crankshaft angle according to the present disclosure for a single cylinder of the engine shown in FIG. 1.
Figure 3:
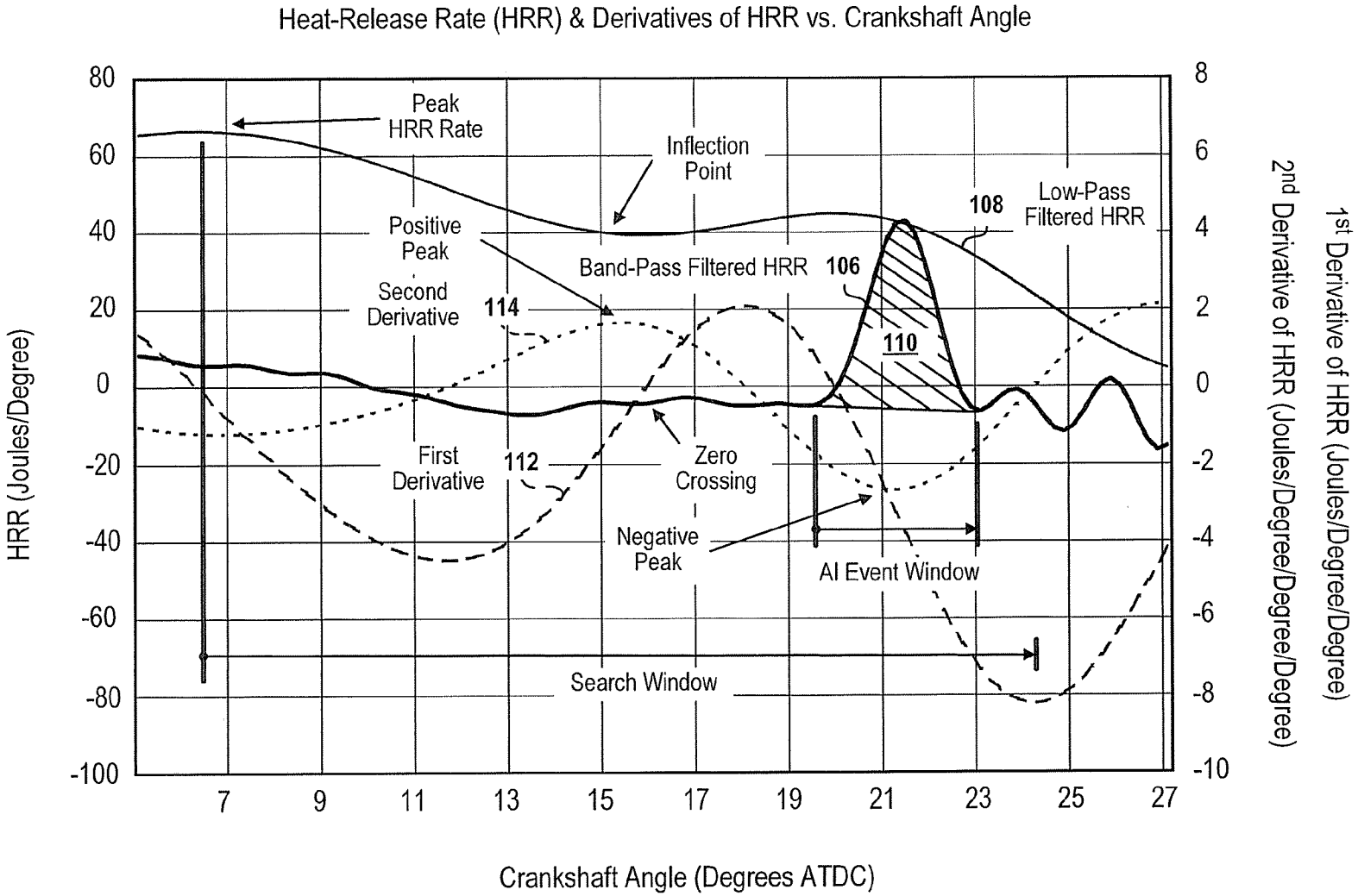
FIG. 3 is another plot illustrating various heat-release rate traces according to the present disclosure for a single cylinder of the engine shown in FIG. 1.
Figure 4:
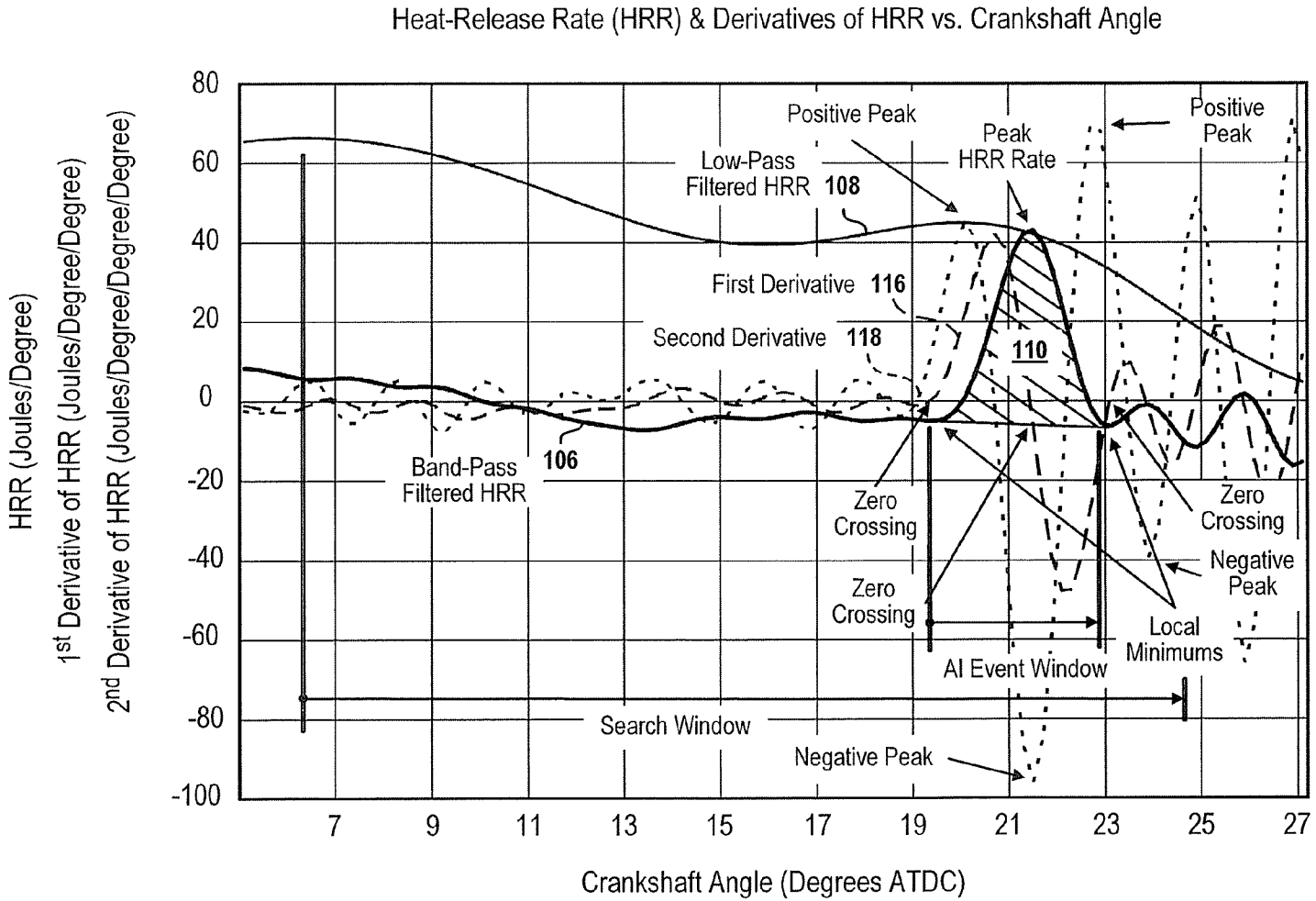
FIG. 4 is another plot illustrating various heat-release rate traces according to the present disclosure for a single cylinder of the engine shown in FIG. 1.

With particular reference to FIGS. 2-4, the principles of estimating knock intensity by estimating the auto-ignition energy and determining the auto-ignition energy metric according to the present disclosure will now be described. Engine knock is the effect of the rapid heat release during auto-ignition. The present disclosure provides an alternative approach to estimating knock intensity that includes estimating the auto-ignition energy generated by the heat released during auto-ignition. As such, the present disclosure provides an approach to detecting engine knock. Because auto-ignition is the cause that precedes and may trigger the effect of engine knock, auto-ignition is an early indicator and more sensitive measure of engine knock. As such, auto-ignition is also a precursor of impending engine knock and the engine operating conditions that are conducive to producing engine knock.

Auto-ignition may be observed from a heat-release rate (HRR) waveform for a particular cylinder. The HRR may be calculated based on in-cylinder pressure and volume (i.e., combustion chamber volume) information as a function of crankshaft angle by standard thermodynamic analysis. The HRR waveform may be generated in a signal as a function of crankshaft angle based on periodic HRR calculations.

With particular reference to FIG. 2, an exemplary HRR waveform 100 for a single knocking cylinder is shown in a plot of HRR versus crankshaft angle. The HRR waveform 100 is generally a high frequency waveform representing the apparent heat release rate, which includes the burn (i.e., combustion), resonant frequencies of the chamber, and measurement noise. The measurement noise may be composed of electrical noise generated by the sensors used to generate the HRR waveform (e.g., pressure sensors 34*a-d*), and instrumentation. The measurement noise may be further composed of mechanical noise induced by vibrations in the engine structure and resonant frequencies induced by a short passage that may provide fluid communication between the combustion chamber and the pressure sensor used to sense in-cylinder pressure.

From the HRR waveform 100, a lower frequency waveform 102 representing the burn may be obtained. The lower frequency waveform 102 captures the effects of the burn, which includes spark-initiated combustion (i.e., primary combustion) and the combustion associated with auto-ignition. The auto-ignition component of the burn is labeled in the plot of FIG. 2 and is evidenced by a second peak in the HRR waveform following a first peak of greater magnitude evidencing the primary combustion. It has been observed from the lower frequency waveform 102 that the measurement of the lower frequency component of the burn is independent of the location or mounting of the pressure sensor with respect to the combustion chamber. It has also been observed that the measurement is less sensitive to noise.

From the waveforms 100, 102 the occurrence of engine knock and noise may be observed as the superposition of a higher frequency component of the waveform 100 on top of the lower frequency waveform 102. As illustrated in FIG. 2, the auto-ignition event is evidenced by the rapid increase in the heat-release rate represented in the second peak and precedes a period of high frequency and high amplitude oscillation associated with an engine knock event. Although there is some high frequency oscillation in the HRR waveform 100 prior to and during the auto-ignition event, the HRR waveform 100 changes into a modulated waveform following the beginning of the auto-ignition event. The modulated waveform evidences the combination of several frequencies, including the natural acoustic frequencies of the combustion chamber, that produce a beat frequency or modulation riding on top of the lower frequency waveform 102.

The auto-ignition event may be described by a metric that characterizes the intensity of the auto-ignition event (i.e., auto-ignition intensity). The auto-ignition intensity directly corresponds to knock intensity. In particular, higher auto-ignition intensities correspond to higher knock intensities and vice versa. The auto-ignition intensity may be described by one or more metrics including a peak rate of HRR increase during the auto-ignition event and a peak rate of HRR decrease during the auto-ignition event. A method and system for describing the auto-ignition intensity using a maximum rate of HRR increase during the auto-ignition event is disclosed in commonly assigned U.S. patent application Ser. No. 12/412,729.

The auto-ignition intensity may also be described by a metric that quantifies the auto-ignition energy generated by the heat released during auto-ignition. The present disclosure provides a method and system for estimating the auto-ignition energy generated and determining an auto-ignition energy metric based on the estimated auto-ignition energy. In the method, auto-ignition energy is estimated by separating out the auto-ignition components from a raw HRR waveform (e.g., waveform 100). The method is a frequency-domain method for separating out the frequency components of the raw HRR waveform that are characteristic of the auto-ignition event. It has been observed from an analysis of raw HRR waveforms corresponding to various levels of engine knock, including no knock, borderline knock, moderate knock, and heavy knock, that the primary combustion event triggering auto-ignition has a frequency content much lower than the frequency content of the resulting auto-ignition event.

The method separates the auto-ignition information from the primary combustion information in the raw HRR waveform by filtering the raw HRR waveform to remove the higher frequencies associated with knock and noise. A low-pass filter may be applied to the HRR waveform in this step to remove the associated higher frequencies. Next, the resulting low-pass filtered HRR waveform may be filtered to remove the lower frequencies associated with the primary combustion event. A high-pass filter may be applied to the low-pass filtered HRR waveform in this step to remove the associated lower frequencies. Alternately, a band-pass filter may be applied to the raw HRR waveform to remove the higher frequencies associated with knock and noise and the lower frequencies associated with the primary combustion event in a single step. In both cases, the resulting band-pass filtered HRR waveform characterizes the auto-ignition event. An exemplary band-pass filtered HRR waveform 104 is shown in FIG. 2.

Referring now to FIGS. 3-4, other exemplary band-pass filtered HRR waveforms 106 that characterize auto-ignition events according to the foregoing method are shown in plots of HRR versus crankshaft angle. For purposes of clarity, the corresponding raw, unfiltered HRR waveforms are not shown in FIGS. 3-4. Exemplary low-pass filtered HRR waveforms that can be obtained by filtering the higher frequencies associated with knock and noise from the corresponding unfiltered HRR waveforms are designated by reference numeral 108.

According to the method of the present disclosure, the auto-ignition energy is estimated by determining an area 110 under the band-pass filtered HRR waveform 106 during the auto-ignition event. The area 110 may be determined by integrating the band-pass filtered HRR waveform 106 over a window corresponding to the auto-ignition event (i.e., auto-ignition event window). The auto-ignition event window may be determined by determining a search window within the band-pass filtered HRR waveform 106 within which the auto-ignition event may be identified. The search window may be determined from the low-pass filtered HRR waveform 108.

As discussed above, it has been observed that auto-ignition, when it occurs, generally occurs after a peak in the heat-release rate caused by primary combustion and causes a second rise in the heat-release rate. Accordingly, the search window may be set to begin at a crankshaft angle corresponding to a peak in the heat-release rate indicated by the low-pass filtered HRR waveform 108.

However, auto-ignition may occur early in the burn and near a point (i.e., crankshaft angle) where the primary combustion event would have a peak in the heat-release rate. Auto-ignition may occur early when, for example, the engine is operating at low speed, high load, and high spark advance. When this happens, the peak in the heat-release rate may be due to the auto-ignition event and the peak in the heat-release rate may occur at the peak of the auto-ignition event. If the search window is set to begin at the crankshaft angle corresponding to the peak heat-release rate, the auto-ignition event may be missed. For this case, a point of inflection in the heat-release rate may be used to set the beginning of the search window.

The inflection point corresponds to a rapid increase in the heat-release rate due to the sudden onset of the auto-ignition event. The inflection point may be detected from first and second derivative waveforms obtained from the low-pass filtered HRR waveform 108. The inflection point occurs where there is a large positive peak in the second derivative waveform followed by a large negative peak in the second derivative waveform, and where the first derivative is equal to approximately zero. At the inflection point, the first derivative waveform need not cross zero and the first derivative may be positive, negative, or zero.

Accordingly, the search window may be based on the low-pass filtered HRR waveform 108 and first and second derivatives of the low-pass filtered HRR waveform 108. With particular reference to FIG. 3, a first derivative waveform for the low-pass filtered HRR waveform 108 is designated by reference numeral 112 and a second derivative waveform for the low-pass filtered HRR waveform 108 is designated by reference numeral 114. The search window may be set to begin at a crankshaft angle corresponding to a maximum peak in the low-pass filtered HRR waveform 108 or a first inflection point in the low-pass filtered HRR waveform 108, whichever occurs first.

An inflection point preceding a maximum peak in the low-pass filtered HRR waveform 108 is an indication that an auto-ignition event is causing the increase in the low-pass filtered HRR waveform 108 and the subsequent peak in the heat-release rate corresponds to a peak heat-release rate of the auto-ignition event rather than the primary ignition event as discussed above. For illustration only, FIG. 3 illustrates the case where the maximum peak in the heat-release rate precedes the inflection point.

The search window may have a calibrated length (i.e., duration) that is a function of engine speed. In this manner, the search window may be adjusted for the variable duration of the burning process associated with different engine speeds. The length may correspond to a number of degrees of crankshaft rotation within which auto-ignition may occur. More specifically, the length may correspond to a number of degrees within which the peak heat-release rate of the auto-ignition event may occur.

With particular reference to FIG. 4, the auto-ignition event window is bounded by first and second crankshaft angles where the heat-release rate due to auto-ignition, as represented by the band-pass filtered HRR waveform 106, increases from a relatively flat level prior to a peak heat-release rate within the auto-ignition search window and decreases down to a relatively flat level after the peak heat-release rate. The level may be relatively flat where an absolute difference between successive values of the band-pass filtered HRR or a difference between first and last values of the band-pass filtered HRR over a predetermined interval (i.e., number of degrees of crankshaft rotation) are below a predetermined threshold. The first and second crankshaft angles may be determined from first and second derivative waveforms obtained from the band-pass filtered HRR waveform 106. The peak heat-release rate may occur where the first derivative of the band-pass filtered HRR waveform 106 crosses zero and there is a negative minimum in the second derivative of the band-pass filtered HRR.

The first and second crankshaft angles may be set to crankshaft angles nearest to the band-pass filtered peak heat-release rate where the second derivative of the band-pass filtered HRR has a positive maximum peak and the first derivative of the band-pass filtered HRR is equal to approximately zero. The first and second crankshaft angles may be set to crankshaft angles where the band-pass filtered HRR waveform 106 crosses zero, nearest to the band-pass filtered peak heat-release rate. Alternatively, the first and second crankshaft angles may respectively be set to crankshaft angles prior to and after the band-pass filtered HRR waveform 106 crosses zero where there is a local minimum, nearest to the band-pass filtered peak heat-release rate. For illustration only, FIG. 4 illustrates the latter case. The local minimums may be minimums nearest to the peak heat-release rate, as shown.

It should be noted that one or both the first and second crankshaft angles may occur outside the auto-ignition search window. A first derivative waveform for the band-pass filtered HRR waveform 106 is designated by reference numeral 116 and a second derivative waveform for the band-pass filtered HRR waveform 106 is designated by reference numeral 118. The search window and auto-ignition event window, described in further detail below, are also identified and illustrated in FIGS. 3-4.

The auto-ignition energy metric, as discussed in further detail below, may be determined based on the estimated auto-ignition energies for one or more combustion cycles of one or more of the cylinders (e.g., cylinders 30*a-d*) of the engine. The auto-ignition energy metric may be used to regulate the auto-ignition energy in one or more cylinders. The auto-ignition energies and auto-ignition energy metric may be used in a closed-loop knock control system that regulates the auto-ignition energy by selectively adjusting one or more engine operating parameters, such as spark timing. For example, where the auto-ignition energy is greater than a desired level, the spark timing may be retarded to reduce the auto-ignition energy to the desired level. Conversely, where the auto-ignition energy is less than a desired level, the spark timing may be increased to increase the auto-ignition energy to the desired level. Alternatively or additionally, auto-ignition energy may be selectively adjusted (i.e., adjusted or not) depending on whether the auto-ignition energy is greater than a threshold energy.

Figure 5:
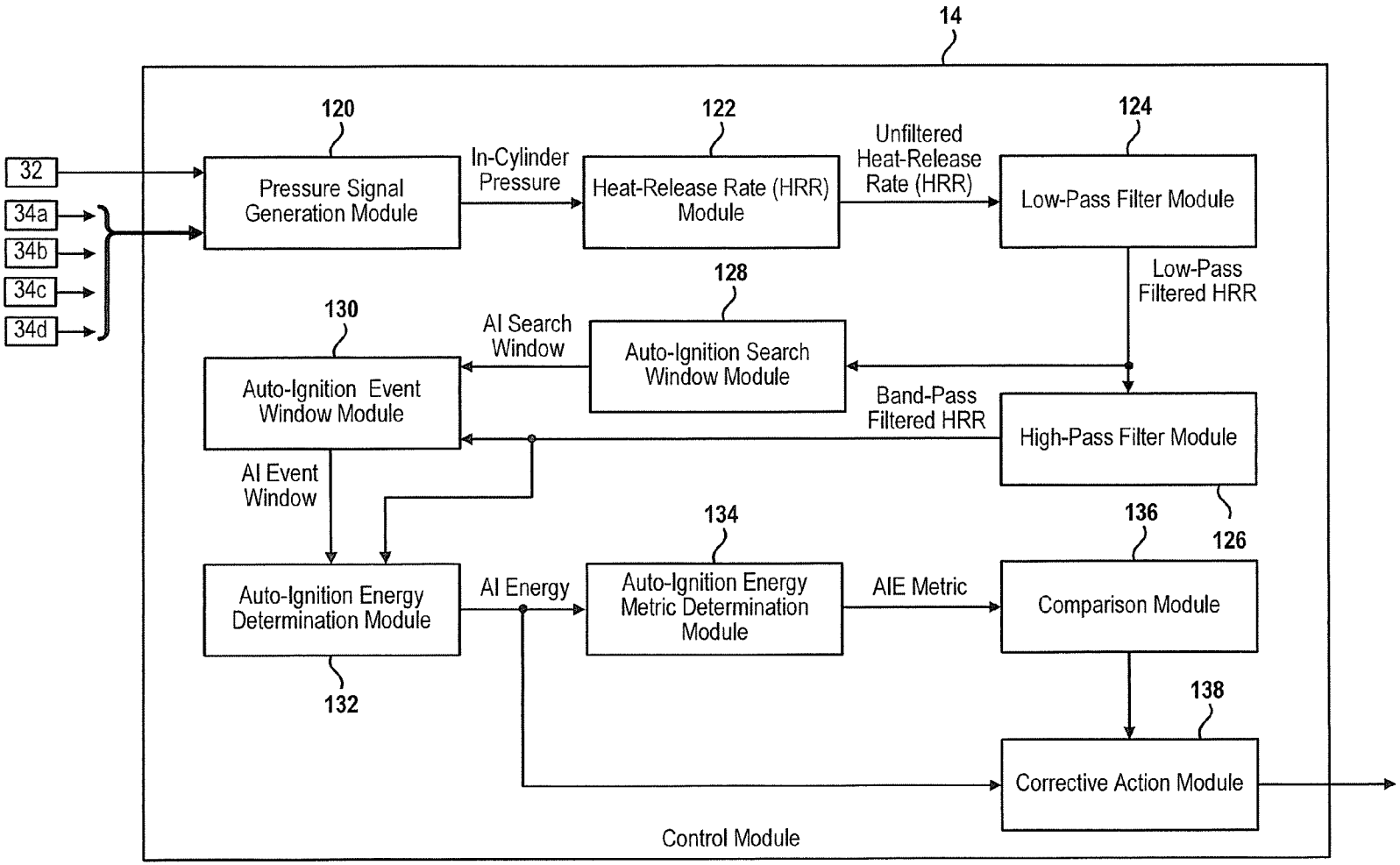
FIG. 5 is a functional block diagram of an exemplary engine control module according to the present disclosure.

With particular reference to FIG. 5, an exemplary implementation of the control module 14 is shown and will now be described in detail. The control module 14 includes sub-modules that work together to implement the principles of the foregoing method. Exemplary sub-modules are shown in FIG. 5 and will be described in further detail below. It will be appreciated that in alternate implementations, the sub-modules may be combined and/or divided. It will be further appreciated that one or more of the sub-modules may be implemented in other modules (not shown) of the engine and knock control system 10 that may communicate with the control module 14.

A pressure signal generation module 120 may generate an in-cylinder pressure signal for each of the cylinders 30*a-d* based on the signals generated by the respective pressure sensors 34*a-d*. The pressure signal generation module 120 may receive the signals generated by each of the pressure sensors 34*a-d*. The pressure signal generation module 120 may convert the signals received into corresponding in-cylinder pressure signals indicating the pressures sensed at predetermined rotational angles (i.e., positions) of the crankshaft 20. As such, the in-cylinder pressure signals may indicate the pressures sensed at a predetermined interval of crankshaft rotation. For example, the in-cylinder pressure signals may indicate in-cylinder pressure every one degree of crankshaft rotation. The pressure signal generation module 120 generates the in-cylinder pressure signals such that the signals are usable by the other sub-modules. The in-cylinder pressure signals may be unfiltered signals. The pressure signal generation module 120 may output the in-cylinder pressure signals as shown.

An HRR module 122 receives the in-cylinder pressure signals and may generate an unfiltered HRR signal for each of the cylinders 30*a-d* based on the corresponding signals received. The HRR module 122 may generate the unfiltered HRR signal for each of the cylinders 30*a-d* by calculating the heat-release rate every combustion cycle. The HRR module 122 may calculate the apparent heat-release rate using the following formula (Equation 1):

$$dQ/d\text{Theta}=[1/(\text{gamma}-1)]*V*dP/d\text{Theta}+[\text{gamma}/(\text{gamma}-1)]*P*dV/d\text{Theta}.$$

In Equation 1, dQ/dTheta is the apparent heat-release rate, gamma is the specific heat ratio of the cylinder mixture, V is the volume of the combustion chamber at the current crankshaft angle, P is the in-cylinder pressure at the current crankshaft angle, and theta is the current crankshaft angle. Alternately, gamma may be a polytropic coefficient of the cylinder mixture that is determined based on the corresponding in-cylinder pressure signal. The HRR module 122 may output the unfiltered HRR signals as shown.

A low-pass filter module 124 receives the unfiltered HRR signals and may generate a low-pass filtered HRR signal for each of the cylinders 30*a-d* by filtering the signals received to remove the high frequencies associated with knock and noise. As such, the low-pass filter module 124 may apply a low-pass filter to each of the unfiltered HRR signals that has a cut-off frequency suitably set to separate the lower frequencies associated with the burn from the higher frequencies associated with knock and noise. The low-pass filter module 124 may output the low-pass filtered HRR signals as shown.

A high-pass filter module 126 receives the low-pass filtered HRR signals and may generate a band-pass filtered HRR signal for each of the cylinders 30*a-d* by filtering the signals received to separate the frequencies associated with auto-ignition from the lower frequencies associated with primary combustion. As such, the high-pass filter module 126 may apply a high-pass filter to each of the low-pass filtered HRR signals that has a cut-off frequency suitably set to attenuate the lower frequencies associated with primary combustion. The high-pass filter module 126 may output the band-pass filtered HRR signals as shown.

The low-pass and high-pass filter modules 124, 126 may each apply a digital filter to the signals received. Additionally, the filter applied may be one of various types. For example, the filter applied may be a single pass filter that adds a phase shift, a forward-backward filter that adds no phase shift, or a double-pass filter that adds no phase shift. Additionally, the filter applied may add a delay to the signals that depends on the order of the filter applied.

The cut-off frequencies of the filters applied are set to maintain a bandwidth that is suitable for achieving a good level of auto-ignition energy estimation by rejecting the effect of primary combustion and knock and noise in the in-cylinder pressure signals. The cut-off frequencies of the filters applied by the low-pass and high-pass filter modules 124, 126 may vary and may be a function of engine speed in order to provide a suitable level of noise reduction for achieving a good level of auto-ignition energy estimation.

An auto-ignition search window module 128 receives the low-pass filtered HRR signals for each of the cylinders 30*a-d* and determines an auto-ignition search window within the band-pass filtered HRR signals where a subsequent search for the auto-ignition event will be performed. The auto-ignition search window module 128 determines the beginning point for the search window for a particular cylinder by determining, from the low-pass filtered HRR signal for the cylinder, the crankshaft angle at the location of the peak heat-release rate and the crankshaft angle at the point of the first inflection in the heat-release rate. The auto-ignition search window module 128 sets the beginning of the search window to the crankshaft angle that occurs first.

The auto-ignition search window module 128 sets the ending crankshaft angle of the search window such that the search window has a calibrated length. The calibrated length may be a function of engine speed such that the search window is adjusted to compensate for the variable duration of the burn associated with different engine speeds. A search window may be determined for each combustion cycle (i.e., on a cycle-by-cycle basis). The auto-ignition search window module 128 may output the auto-ignition search window information (i.e., beginning and ending crankshaft angles) as shown.

The auto-ignition search window module 128 may determine the locations of the peak heat-release rate and point of the first inflection based on first and second derivatives of the low-pass filtered HRR signal as discussed above. As such, the auto-ignition search window module 128 may process each of the low-pass filtered HRR signals to obtain a first derivative waveform and a second derivative waveform from which the beginning of the search window may be determined.

While the beginning of the search window may be found in the foregoing manner, additional measures may be used to inhibit misdetection of the locations of peak heat-release rate and the point of first inflection. For example, cumulative heat release and in-cylinder pressures may be monitored when determining the foregoing locations. In general, it has been observed that the peak heat-release rate and the point of first inflection occur at crankshaft angles near fifty percent of the cumulative heat released in a particular combustion cycle. It has also been observed that auto-ignition generally occurs after a peak in in-cylinder pressure caused by primary combustion. Accordingly, the auto-ignition search window module 128 may further determine the locations of the peak heat-release rate and the point of first inflection, and thereby establish the beginning of the search window, based on other operating measures, such as cumulative heat release and in-cylinder pressures.

An auto-ignition event window module 130 receives the auto-ignition search window information and band-pass filtered HRR signals for each of the cylinders 30*a-d*. The auto-ignition event window module 130 determines an auto-ignition event window for each of the cylinders 30*a-d* by determining a first crankshaft angle within the search window where a peak in the band-pass filtered HRR signal occurs. Next, the auto-ignition event window module 130 determines second and third crankshaft angles where the heat-release rate due to auto-ignition, as represented by the corresponding band-pass filtered HRR, increases from a relatively flat level prior to the peak and decreases down to a relatively flat level after the peak, respectively.

The second and third crankshaft angles on both sides of the peak correspond to the beginning and ending points of the auto-ignition event and define the auto-ignition event window. The auto-ignition event window module 130 may determine the crankshaft angles that bound the auto-ignition event window based on first and second derivatives of the band-pass filtered HRR signals as discussed above. As such, the auto-ignition event window module 130 may process each of the band-pass filtered HRR signals to obtain a first derivative waveform and a second derivative waveform from which the crankshaft angles may be determined. The auto-ignition event window module 130 outputs the auto-ignition event window information as shown.

An auto-ignition energy determination module 132 receives the auto-ignition event window information and band-pass filtered HRR signals and determines an auto-ignition energy for each of the cylinders 30*a-d*. The auto-ignition energy determination module 132 determines the auto-ignition energy as an area under a segment of the band-pass filtered HRR signal defined by the auto-ignition event window. In other words, the auto-ignition energy is determined as the area under the segment of the band-pass filtered HRR signal between the second and third crankshaft angles. The auto-ignition energy determination module 132 may determine the auto-ignition energy by integrating the band-pass filtered HRR signal over the auto-ignition event window. The area may include the entire area under the segment, and therefore, the integration may be performed on a level-shifted segment of the band-pass filtered HRR signal to avoid negative areas of integration. Auto-ignition energy may be determined on a cycle-by-cycle basis. The auto-ignition energy determination module 132 may output the auto-ignition energies as shown.

When determining the auto-ignition energy, the band-pass filtered HRR signal may be processed such that from the HRR information indicated every one degree of crankshaft rotation, HRR information at fractional degrees of crankshaft rotation is obtained. For example, HRR information every one-tenth or two-tenths of a degree of crankshaft rotation may be obtained. In this manner, a more accurate estimate for the auto-ignition energy may be obtained. A suitable interpolation method may be applied to the band-pass filtered HRR signal to obtain HRR information every one-tenth of a degree of crankshaft rotation. Alternately, the in-cylinder pressure signals may be processed by a suitable interpolation method to obtain in-cylinder pressure information every one-tenth of a degree that is used to obtain HRR information every one-tenth of a degree. The auto-ignition energy determination module 132 may output the auto-ignition energy obtained in the foregoing manner for each of the cylinders 30*a-d*.

An auto-ignition energy metric determination module 134 receives the auto-ignition energy information for each of the cylinders 30*a-d* and determines an auto-ignition energy metric (AIEM) based on the information received. An AIEM may be determined for each cylinder independently, or a single AIEM for the engine 12 may be determined. The AIEM may be determined on a cycle-by-cycle basis, or as discussed herein, on an engine cycle basis. In other words, the AIEM may be determined once every time a firing of every cylinder in the engine 12 has occurred. The AIEM for the engine 12 may be output every engine cycle.

The AIEM may be set equal to one of the auto-ignition energy and a moving average auto-ignition energy estimate for a single cylinder. Alternatively, the AIEM may be set to a maximum of one of the auto-ignition energies and a moving average of the auto-ignition energy for two or more cylinders. As discussed herein, the AIEM is determined by first calculating a moving average of auto-ignition energy for each of the cylinders 30*a-d*. A predetermined number (N) of combustion cycles of data that define a window of data samples for the moving average may be suitably set to obtain an auto-ignition energy estimate for each cylinder that more accurately represents the magnitude and frequency of auto-ignition events occurring within each cylinder. The moving average may provide a better estimate by accounting for possible misdetection and by filtering out the effects of normal combustion variability. Next, the moving average of auto-ignition energy for each of the cylinders is compared and the AIEM is set to the current maximum moving average value.

A comparison module 136 receives the AIEM for the engine 12 and compares the NEM and a target auto-ignition energy (AIE). The comparison module 136 outputs a status signal indicating whether AIEM is greater than or less than the target AIE. The target AIE may be a calibrated value stored in memory. Alternately, the target AIE may be a function of engine operating conditions such as, but not limited to, engine speed, load, and temperature. The target AIE may further be based on predetermined control parameters stored in memory tables. The comparison module 136 may compare the AIEM and the target AIE every engine cycle and output the status signal to indicate the current status of the AIEM.

A corrective action module 138 receives the status signal and may take corrective action to reduce (or increase) the auto-ignition energy such that the AIEM is decreased (or increased) to the target AIE. The corrective action may include selectively adjusting the spark timing to reduce (or increase) the auto-ignition energy. Corrective action may be taken as part of a closed-loop system that uses the status signal as feedback. The closed-loop system may also use the auto-ignition energy for each of the cylinders 30*a-d* and the AIEM for the engine as feedback. As such, the corrective action module 138 may receive the auto-ignition energy as shown. The corrective action module 138 may output a corrective action status signal indicating whether corrective action is being undertaken to decrease (or increase) auto-ignition to the target AIE.

Figure 6:
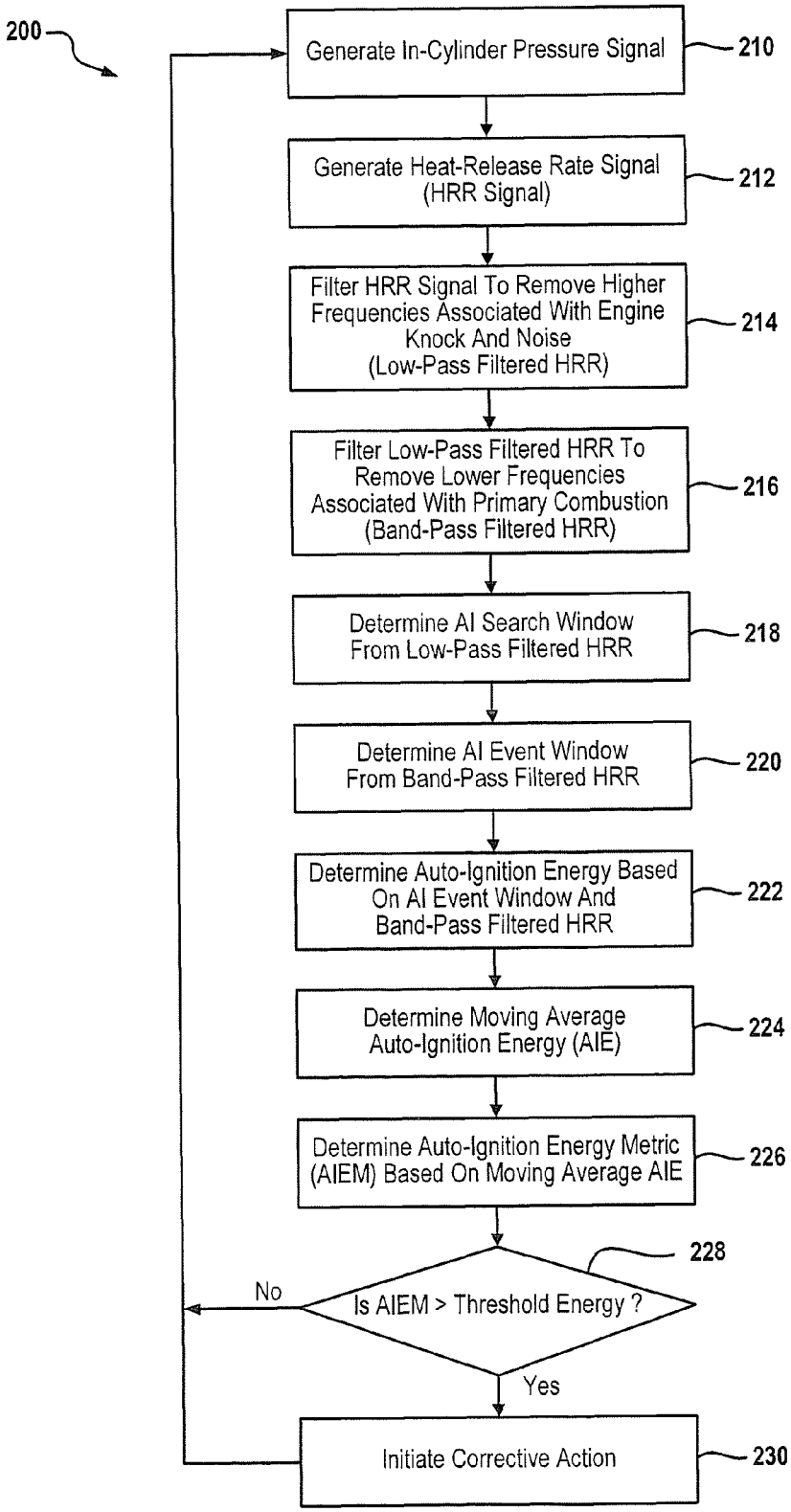
FIG. 6 is a flow chart illustrating exemplary steps of a method for controlling an engine according to the present disclosure.

With particular reference to FIG. 6, an exemplary method 200 according to the present disclosure is shown. The method 200 may be implemented in a knock control system, such as the engine and knock control system 10 described above. For example, the method 200 may be implemented in one or more modules and/or sub-modules of the system. The method 200 may be used during engine development to develop base spark timing tables that are used in production engines to control spark timing and thereby inhibit engine knock under various engine operating conditions. Additionally and/or alternatively, the method 200 may be used in a production engine system that implements closed-loop control on one or more engine operating conditions, such as spark timing, to manage auto-ignition and thereby inhibit engine knock.

The method 200 is a frequency-domain-based method for estimating auto-ignition energy and knock intensity for an engine in real time. In the exemplary method discussed herein, the method 200 estimates the auto-ignition energy in each of the cylinders (i.e., combustion chambers) of the engine on a cycle-by-cycle basis and determines an auto-ignition energy metric indicative of the auto-ignition energy and knock intensity of the engine. The auto-ignition energy metric is determined every engine cycle.

The method 200 estimates the auto-ignition energy based on in-cylinder pressures. The in-cylinder pressures may be sensed by pressure sensors in fluid communication with respective cylinders, such as the pressure sensors 34*a-d* discussed above. In-cylinder pressures may be obtained at a regular interval of crankshaft rotation. A crankshaft position sensor, such as the crankshaft sensor 32 discussed above, may be used to sense crankshaft rotation.

The method 200 begins in step 210 where control generates an in-cylinder pressure signal for one or more cylinders of the engine. As discussed herein, control generates an in-cylinder pressure signal for each cylinder of the engine. Each in-cylinder pressure signal indicates the pressure within the respective cylinder at a predetermined interval of crankshaft rotation suitable under the method 200. In-cylinder pressures generated every one degree of crankshaft rotation have been found suitable when combined with interpolation methods that provide in-cylinder pressures (or a corresponding heat-release rate) at a greater resolution. For example only, interpolation methods that provide in-cylinder pressures between one-tenth and two-tenths of a degree may be suitable. The in-cylinder pressure signals may be unfiltered signals generated by pressure sensors that sense in-cylinder pressure. A crankshaft sensor may be used to trigger generation of the in-cylinder pressure signals.

Control continues in step 212 where control calculates an apparent heat-release rate for each cylinder based on the respective in-cylinder pressure signal and generates an HRR signal for each cylinder indicating the calculated apparent heat-release rate. Control may calculate the apparent heat-release rate according to Equation 1 described above. The HRR signal may indicate the apparent heat-release rate at the same predetermined interval of crankshaft rotation that the in-cylinder pressure information is generated.

Control continues in step 214 where control generates a low-pass filtered HRR signal for each cylinder by filtering the respective HRR signal to remove the high frequencies associated with knock and noise. The noise filtered generally will be composed of electrical noise generated by the sensors used to generate the HRR waveform (e.g., pressure sensors) and any instrumentation. The noise filtered generally will also be further composed of mechanical noise induced by vibrations in the engine structure and any resonant frequencies induced by short passages that may provide fluid communication between the combustion chamber and the pressure sensors used to sense in-cylinder pressures.

In step 214, control may apply a low-pass filter to each of the unfiltered HRR signals that has a cut-off frequency suitably set to separate the lower frequencies associated with the burn from the higher frequencies associated with knock and noise. The low-pass filter may be a discrete filter and may be one of various types. For example, the low-pass filter may be a single pass filter that adds a phase shift, a forward-backward filter that adds no phase shift, or a double-pass filter that adds no phase shift. The low-pass filter may add a delay to the signals, depending on the order of the filter.

Control continues in step 216 where control generates a band-pass filtered HRR signal for each cylinder by filtering the respective low-pass filtered HRR signal to remove the lower frequencies associated with primary combustion. In step 216, control may apply a high-pass filter to each of the low-pass filtered HRR signals that has a cut-off frequency suitably set to attenuate the lower frequencies associated with primary combustion. The high-pass filter may be a digital filter and may be one of the various types discussed above.

Control continues in step 218 where control determines an auto-ignition search window within the band-pass filtered HRR signal for each cylinder. Control may determine an auto-ignition search window for each combustion event of a cylinder. Control determines the beginning point for the search window for a particular cylinder by determining, from the low-pass filtered HRR signal for the cylinder, the crankshaft angle at the location of the peak heat-release rate and/or the crankshaft angle at the point of the first inflection in the heat-release rate. Control sets the beginning of the search window to the crankshaft angle that occurs first. When determining the locations of the peak heat-release rate and/or the point of first inflection, control may monitor other operating conditions, such as cumulative heat release and in-cylinder pressures to avoid misdetecting the locations.

Control may set the ending of the search window such that the search window has a predetermined length. The length may be a function of engine speed to compensate for the variable duration of the burn associated with different engine speeds. The length may correspond to a number of degrees of crankshaft rotation within which auto-ignition may occur. Alternately, control may set the ending of the search window to correspond to a predetermined percent of the heat released during the burn in the corresponding cylinder combustion event. The percent may be a function of one or more engine operating conditions such as, but not limited to, engine speed, load, and temperature.

Control may determine the location of the peak heat-release rate as the crankshaft angle where the first derivative of the low-pass filtered HRR crosses zero and there is a negative minimum in the second derivative of the low-pass filtered HRR. Accordingly, control may process each of the low-pass filtered HRR signals to obtain first and second derivative signals. Control may determine the point of the first inflection based on first and second derivatives of the low-pass filtered HRR signal. In particular, the point of first inflection may be determined by determining the crankshaft angle where there is a large positive peak in the second derivative of the heat-release rate followed by a large negative peak in the heat-release rate, and where the first derivative is equal to approximately zero. Thus, in step 218, control may process each of the low-pass filtered HRR signals to obtain a first derivative waveform and a second derivative waveform from which control may determine the beginning of the search window.

Control continues in step 220 where control determines an auto-ignition event window for each band-pass filtered HRR signal that will be processed in a subsequent step to estimate the auto-ignition energy of the auto-ignition event. Control determines the auto-ignition event window for each of the band-passed filtered HRR signals based on the corresponding auto-ignition search window.

Control may determine a first crankshaft angle within the search window where a peak in the corresponding band-pass filtered HRR signal occurs. Control may set the beginning and ending points of the auto-ignition event window to correspond to second and third crankshaft angles where the heat-release rate represented by the band-pass filtered HRR signal increases from a relatively flat level prior to the peak and decreases down to a relatively flat level after the peak, respectively. Control may determine the location of the peak heat-release rate based on first and second derivatives of the band-pass filtered HRR signal. Accordingly, control may process each of the band-pass filtered HRR signals to obtain corresponding first and second derivative signals. Control may determine the location as the crankshaft angle where the first derivative of the band-pass filtered HRR signal crosses zero and there is a negative minimum in the second derivative of the band-pass filtered HRR. Finding the zero crossing within the auto-ignition search window is equivalent to finding the peak heat-release rate of the band-pass filtered HRR signal described above.

Control may determine the locations of the second and third crankshaft angles as the crankshaft angles nearest to the peak heat-release rate where the second derivative of the band-pass filtered HRR has a positive maximum and the first derivative of the band-pass filtered HRR is equal to approximately zero. The second and third crankshaft angles may be set to crankshaft angles where the band-passed filtered HRR crosses zero. One or both the second and third crankshaft angles may fall outside the auto-ignition search window.

Control continues in step 222 where control periodically determines the auto-ignition energy for each of the cylinders based on the corresponding band-pass filtered HRR signals and auto-ignition event windows. Control may determine the auto-ignition energy for each cylinder on a cycle-by-cycle basis based on the band-pass filtered HRR signal. Control determines the auto-ignition energy by determining an area under a segment of the band-pass filtered HRR signal corresponding to the auto-ignition event window. Control may determine the auto-ignition energy for each cylinder by integrating the respective band-pass filtered HRR signal over the corresponding auto-ignition event window. Control may integrate level-shifted band-pass filtered HRR signals when determining the auto ignition energy.

When determining the auto-ignition energy, control may process the band-pass filtered HRR signal within the auto-ignition event window such that HRR information may be obtained at intervals of crankshaft rotation less than the predetermined interval at which the HRR information is generated. For example, control may process the band-pass filtered HRR signal to obtain HRR information within the auto-ignition event window every one-tenth of a degree of crankshaft rotation. Control may implement one of a variety of suitable methods, such as an interpolation method, to obtain HRR information with more fidelity. In this manner, a suitable balance may be achieved between the accuracy of the auto-ignition energy estimate determined in step 222 and the frequency at which in-cylinder pressure and HRR information is generated in steps 210-216.

Control continues in step 224 where control determines a moving average auto-ignition energy for each cylinder based on the auto-ignition energy determined each cycle in step 222. Control may determine a moving average auto-ignition energy to account for possible misdetection of knock and to filter out the effects of normal combustion variability within the cylinder. In this manner, control may obtain an auto-ignition energy estimate for the cylinder that more accurately represents the magnitude and frequency of auto-ignition events for the cylinder. Control may determine a simple moving average of a predetermined number (N) of combustion cycles suitable under the method 200.

Control continues in step 226 where control determines the auto-ignition energy metric based on the auto-ignition energy for one or more cylinders. Control may set the auto-ignition energy metric equal to one of the auto-ignition energy and the moving average auto-ignition energy estimate for a single cylinder. Alternatively, control may compare the auto-ignition energy and/or moving average auto-ignition energy estimates for two or more of the cylinders and may set the auto-ignition energy metric for a given engine cycle to the maximum of the auto-ignition energies or the moving average auto-ignition energy estimates. As discussed herein, control compares the moving average auto-ignition energy estimates for all of the cylinders and sets the auto-ignition energy metric for the given engine cycle to the maximum moving average auto-ignition energy estimate.

Control continues in step 228 where control compares the auto-ignition energy metric for the current engine cycle and a threshold auto-ignition energy. If the auto-ignition energy metric for the current engine cycle is greater than the threshold auto-ignition energy, then control proceeds in step 230 where corrective action is taken, otherwise control loops back as shown. The threshold auto-ignition energy may be a predetermined value corresponding to a knock intensity below which the engine is to be operated. The target auto-ignition energy may be predetermined on the basis of achieving improved engine performance and reliability and/or a reduction in the audible perception of engine knock.

In step 230, control initiates corrective action to reduce auto-ignition in one or more cylinders of the engine and control loops back to begin another control loop for the next cycle. Once corrective action is initiated in step 230, control may reduce auto-ignition by adjusting one or more engine operating conditions. For example, control may reduce auto-ignition by retarding the spark timing. Corrective action may include closed-loop control of one or more engine operating conditions to maintain auto-ignition in the engine at or below the threshold auto-ignition energy. The closed-loop control may employ commonly known methods of thresholding and hysteresis to prevent corrective action which is overly active.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system for an engine comprising:

a heat-release rate (HRR) module that generates an HRR signal based on in-cylinder pressures of a cylinder of said engine;

a first filter module that generates a first filtered HRR signal indicative of a first HRR due to combustion in said cylinder by filtering said HRR signal;

a second filter module that generates a second filtered HRR signal indicative of a second HRR due to auto-ignition in said cylinder by filtering one of said HRR signal and said first filtered HRR signal;

an auto-ignition energy determination module that determines an auto-ignition energy of said cylinder based on said first and second filtered HRR signals; and a corrective action module that selectively adjusts auto-ignition of said engine based on said auto-ignition energy.

2. The control system of claim 1 wherein said first filter module generates a low-pass filtered HRR signal by applying a low-pass filter to said HRR signal and generates a band-pass filtered HRR signal by one of applying a band-pass filter to said HRR signal and applying a high-pass filter to said low-pass filtered HRR signal, and wherein said auto-ignition energy is determined based on said low-pass and band-pass filtered HRR signals.

3. The control system of claim 2 further comprising a window determination module that determines a search window for an auto-ignition event based on said low-pass filtered HRR signal and that determines an auto-ignition event window for said auto-ignition event based on said band-pass filtered HRR signal and said search window, wherein said auto-ignition determination module determines said auto-ignition energy based on an area defined by a segment of said band-pass filtered HRR signal corresponding to said auto-ignition event window.

4. The control system of claim 3 wherein said window determination module sets said search window to begin at one of a first crankshaft position at a maximum peak in said low-pass filtered HRR signal and a second crankshaft position at an inflection point in said low-pass filtered HRR signal, and wherein said search window has a predetermined duration that is a function of one of a speed, load, and temperature of said engine.

5. The control system of claim 4 wherein said predetermined duration is further based on a predetermined percent of a total heat released during a combustion event.

6. The control system of claim 3 wherein said window determination module locates a maximum peak in said band-pass filtered HRR signal within said search window, determines a first crankshaft position where said band-pass filtered HRR signal increases above a first level prior to said peak, determines a second crankshaft position where said band-pass filtered HRR signal decreases below a second level after said peak, and sets said auto-ignition event window to begin at said first crankshaft position and to end at said second crankshaft position.

7. The control system of claim 6 wherein said first and second crankshaft positions correspond to positive peaks in a second derivative of said band-pass filtered HRR signal nearest to said maximum peak where first derivatives of the band-pass filtered HRR signal are approximately equal to zero.

8. The control system of claim 3, wherein said auto-ignition energy determination module determines said auto-ignition energy of said cylinder by integrating said band-pass filtered HRR signal over said auto-ignition event window.

9. The control system of claim 1, wherein said auto-ignition determination module determines a moving average auto-ignition energy for a plurality of combustion cycles of said cylinder, and wherein said corrective action module selectively adjusts said auto-ignition based on a comparison of said moving average auto-ignition energy and a threshold energy.

10. The control system of claim 1 further comprising a metric determination module that determines an auto-ignition energy metric for said engine based on one of a maximum of said auto-ignition energy for a plurality of cylinders of said engine and a maximum moving average auto-ignition energy for a plurality of cylinders of said engine, and wherein said corrective action module selectively adjusts said auto-ignition based on a comparison of a threshold energy and said one of said maximum of said auto-ignition energy and said maximum moving average auto-ignition energy.

11. A method for controlling an engine comprising:

generating a heat-release rate (HRR) signal based on in-cylinder pressures of a cylinder of said engine;

generating a first filtered HRR signal indicative of a first HRR due to combustion in said cylinder by filtering said HRR signal;

generating a second filtered HRR signal indicative of a second HRR due to auto-ignition in said cylinder by filtering one of said HRR signal and said first filtered HRR signal;

determining an auto-ignition energy of said cylinder based on said first and second filtered HRR signals; and selectively adjusting auto-ignition of said engine based on said auto-ignition energy.

12. The method of claim 11 wherein said generating a first filtered HRR signal includes applying a low-pass filter to said HRR signal and said generating a second filtered HRR signal includes one of applying a band-pass filter to said HRR signal and applying a high-pass filter to said low-pass filtered HRR signal, and wherein said auto-ignition energy is determined based on said low-pass and band-pass filtered HRR signals.

13. The method of claim 12 further comprising:

determining a search window for an auto-ignition event based on said low-pass filtered HRR signal; and determining an auto-ignition event window for said auto-ignition event based on said band-pass filtered HRR signal and said search window, wherein said determining an auto-ignition energy includes determining an area defined by a segment of said band-pass filtered HRR signal corresponding to said auto-ignition event window.

14. The method of claim 13 wherein said determining a search window includes setting said search window to begin at one of a first crankshaft position at a maximum peak in said low-pass filtered HRR signal and a second crankshaft position at an inflection point in said low-pass filtered HRR signal, and wherein said search window has a predetermined duration that is a function of one of a speed, load, and temperature of said engine.

15. The method of claim 14 wherein said predetermined duration is further based on a predetermined percent of a total heat released during a combustion event.

16. The method of claim 13 wherein said determining an auto-ignition event window includes locating a maximum peak in said band-pass filtered HRR signal within said search window, determining a first crankshaft position where said band-pass filtered HRR signal increases above a first level prior to said peak, determining a second crankshaft position where said band-pass filtered HRR signal decreases below a second level after said peak, and setting said auto-ignition event window to begin at said first crankshaft position and to end at said second crankshaft position.

17. The method of claim 16 wherein said first and second crankshaft positions correspond to positive peaks in a second derivative of said band-pass filtered HRR signal nearest to said maximum peak where first derivatives of the band-pass filtered HRR signal are approximately equal to zero.

18. The method of claim 13, wherein said determining an area includes integrating said band-pass filtered HRR signal over said auto-ignition event window.

19. The method of claim 11, wherein said determining an auto-ignition energy includes determining a moving average auto-ignition energy for a plurality of combustion cycles of said cylinder, and wherein said selectively adjusting auto-ignition includes comparing said moving average auto-ignition energy and a threshold energy.

20. The method of claim 11 further comprising determining an auto-ignition energy metric for said engine based on one of a maximum of said auto-ignition energy for a plurality of cylinders of said engine and a maximum moving average auto-ignition energy for a plurality of cylinders of said engine, wherein said selectively adjusting auto-ignition includes comparing of a threshold energy and said one of said maximum of said auto-ignition energy and said maximum moving average auto-ignition energy.

* * * * *